US007389632B2

(12) United States Patent
Seiffert et al.

(10) Patent No.: US 7,389,632 B2
(45) Date of Patent: Jun. 24, 2008

(54) APPARATUS FOR DISTRIBUTING SMALL OBJECTS IN A FILL STATION

(75) Inventors: Martin Seiffert, Schelklingen (DE); Harald Litke, Achstetten (DE); Diana Zugenmaier, Laupheim (DE); Roland Koch, Orsenhausen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 11/811,495

(22) Filed: Jun. 11, 2007

(65) Prior Publication Data

US 2008/0006007 A1 Jan. 10, 2008

(30) Foreign Application Priority Data

Jun. 10, 2006 (DE) ..... 10 2006 027 056
May 7, 2007 (EP) ..... 07009154

(51) Int. Cl.
*B65B 47/00* (2006.01)

(52) U.S. Cl. ..... 53/559; 53/246; 15/52.2

(58) Field of Classification Search ..... 53/246, 53/559; 15/52.2, 81; 141/391
See application file for complete search history.

(56) References Cited

U.S. PATENT DOCUMENTS

| | | | | |
|---|---|---|---|---|
| 3,464,182 | A * | 9/1969 | Nichols | 53/559 |
| 4,862,677 | A * | 9/1989 | Roberts et al. | 53/498 |
| 6,358,326 | B1 * | 3/2002 | Brazier | 134/6 |
| 6,510,676 | B1 * | 1/2003 | Gauthier | 53/501 |
| 6,925,782 | B2 * | 8/2005 | Aylward | 53/475 |
| 2003/0172480 | A1 * | 9/2003 | Ueda et al. | 15/98 |
| 2007/0084141 | A1 * | 4/2007 | Gertitschke et al. | 53/244 |

* cited by examiner

*Primary Examiner*—John Sipos
(74) *Attorney, Agent, or Firm*—Andrew Wilford

(57) ABSTRACT

Small objects are loaded into blisters of a passing packaging film in a fill station of a packaging machine. An apparatus for distributing the objects to the blisters has a pair of generally parallel rods extending along respective axes and having inner and outer ends. Respective guides support the rods for movement parallel to their axes, and a bar extends transversely between the outer ends. An actuator mechanism periodically synchronously rotating the rods. Respective couplings between each of the outer ends and the bar transversely shifting the bar relative to the rods on rotation of the rods.

20 Claims, 4 Drawing Sheets

APPARATUS FOR DISTRIBUTING SMALL OBJECTS IN A FILL STATION

FIELD OF THE INVENTION

The present invention relates to an apparatus for distributing small objects in a fill station. More particularly this invention concerns such an apparatus that fills upwardly open blisters of a packaging foil with pills, capsules, or the like in a fill station of a packaging machine.

BACKGROUND OF THE INVENTION

In the production of blister packs of small objects such as pills, capsules, or tablets, it is standard to deposit a large number of the objects on top of a lower packaging film that is formed with an array of upwardly open blisters and that is slowly advancing in a transport direction. The blisters are typically dimensioned so that they can each hold a single one of the object, just filling it and lying below the plane of the upper face of the film. By vibrating the film sweeping the objects across it with a rotating brush or a bar, the objects are moved about such that one finds its way into each blister and the others are pushed to the side. Then an upper film is set atop the filled lower film and the two films are bonded together between the blisters, and finally the laminated-together films are cut into sections each having one or more of the blisters.

The known systems occasionally leave some of the pockets empty, and are also subject to considerable wear. In addition a scraper bar often can catch on and damage one of the objects as it moves back and forth over the film. In general such systems are often the weak link in the production chain, and most rejected packages are the result of faults taking place in the fill station.

OBJECTS OF THE INVENTION

It is therefore an object of the present invention to provide an improved apparatus for distributing small objects in a fill station.

Another object is the provision of such an improved apparatus for distributing small objects in a fill station that overcomes the above-given disadvantages, in particular that the available filling surface is used as efficiently as possible.

SUMMARY OF THE INVENTION

Small objects are loaded into blisters of a passing packaging film in a fill station of a packaging machine. An apparatus for distributing the objects to the blisters has according to the invention a pair of generally parallel rods extending along respective axes and having inner and outer ends. Respective guides support the rods for movement parallel to their axes, and a bar extends transversely between the outer ends. An actuator mechanism periodically synchronously rotating the rods. Respective couplings between each of the outer ends and the bar transversely shifting the bar relative to the rods on rotation of the rods.

According to the invention the transverse straight-line movement of the bar is a lifting and dropping motion, that is vertical. As a result, a directed manipulation of the small objects on the entire available surface is easily and efficiently possible. Consequently, the small objects can be sorted more quickly into the blisters of the feeder base plates or films, thus further increasing the performance capability of the fill station.

For a fast and undisturbed adjustment of the rods, it is particularly advantageous when the individual rods are mounted rotatably in a axially slidable carriages. On the one hand, in this way fast and precisely defined axial adjustment of the individual rods is achieved, and on the other hand this configuration enables exact parallel guiding of the rods relative to each other.

According to the invention the rods are rotated only when moving into or at the axial end positions. This is done by engaging of at least one spindle-shaped cam element fixed on the machine frame with a pusher cam element carried on the rod. As a result of this forced mechanical guidance of the cam elements, and hence of the rod, a reproducible rotational movement becomes possible, which can be varied within a wide range by selecting a suitable design of the machine cam element and the rod cam element engageable with it. Furthermore, a selective and hence cost-efficient replacement of components subject to wear and tear is enabled.

For precise transmission of the forces from the rod cam element to the rod as well as for a limitation of the axial displacement of the rod, the rod cam element is fixed angularly on the respective rod and also secured against axial displacement thereon. An alternative embodiment of the invention where the rod cam element is secured against displacement contrary to the advancement direction of the rod only by an axial locking element, optionally with the integration of an elastic component, is likewise conceivable.

A particularly preferred embodiment of the apparatus according to the invention is characterized in that there are two rod cam elements on either side of the slide of the rod. This configuration enables for one an easy definition of a delimitation of the axial movements of the individual rod, and secondly the slide can be secured on the rod to prevent axial displacement by direct contact of the rod cam elements with the faces of the slide without requiring further components.

According to a particularly preferred embodiment of the invention, the slide can be shifted axially by a servomotor or is pressure-actuated, particularly by means of a pneumatic actuator or motor. In this way, the speed of the axial forward or backward movement can be easily controlled, and the movement can be decelerated likewise in a controlled fashion going into and out of the end positions.

So as to guarantee reliable transmission of forces from the servomotor to the slide, while using a simple design, it is a toothed belt is interposed between the servomotor and the slide. This furthermore provides the opportunity to derive the movement of both rods of the apparatus according to the invention from only a single drive motor.

To fix the rods in their respective rotational positions and thus to fix the bar in its relative height to the feeder base plate or films comprising the blisters, at least one element is provided for releasably retaining of the angular end positions of the rod on the slide and/or the rod cam element. According to the invention, this element may be formed by magnets and/or a mechanical catch.

Alternatively to an adjustment only in the end positions of the axial movement, it is possible to guide each of the rods in a sleeve that is in rotatable about its longitudinal axis by means of a drive mechanism, so that the rotator adjustment of the rod can be brought abut in every axial position.

To this end the drive mechanism is formed by a pneumatic drive that acts on the sleeve by means of a lever system. Here the sleeve is formed with an axially extending cutout through which a carriage is connected to the rod, which carriage is associated with the toothed belt serving for axial displacement.

The straight-line transverse movement of the bar is done by eccentrics mounted on the free ends of the rods and engaged in radial cam formations of the bar. It is particularly advantageous if a pin or stud is provided on the eccentric disk for engagement in the radial cam and if the eccentric disk is attached to the free end of the rod by a detachable connection. This simple design enables a reliable and particularly easy-to-maintain operation since the individual parts subject to mechanical wear and tear can be individually replaced. Furthermore, the scope of the lifting motion of the bar cam be varied by simply replacing the eccentric disk as well as the component with the radial cam.

For precise guidance of the bar for performing the lifting motion, the bar has vertically elongated throughgoing holes through which the rods extend and by means of which the bar is forcibly guided on the rods or the connecting piece upon rotation of the rods.

In order to be able to manipulate small objects having varying shapes, sizes and configurations on the filling plane defined by the top face of the blister film, a brush strip with is mounted on the lower edge of the bar. This strip may vary in varying thickness and configuration, as a function of the small objects to be manipulated. There are further alternative embodiments for the brush strip according to the invention, which embodiments can be formed by rotating brushes, a scraper or the like.

BRIEF DESCRIPTION OF THE DRAWING

The above and other objects, features, and advantages will become more readily apparent from the following description, reference being made to the accompanying drawing in which.

SPECIFIC DESCRIPTION

As seen in FIGS. 1 to 5 and 8 a apparatus for distributing small objects O such as tablets, capsules pills a the like to blisters B of a film F moving in a horizontal travel direction D through a fill station S of a packaging machine. This apparatus has two rods 2 defining respective axes A and extending parallel to each other. As described below, the rods 2 can also be limitedly rotated about their axes A, which action is done at the end of the longitudinal strokes.

Figure 1:
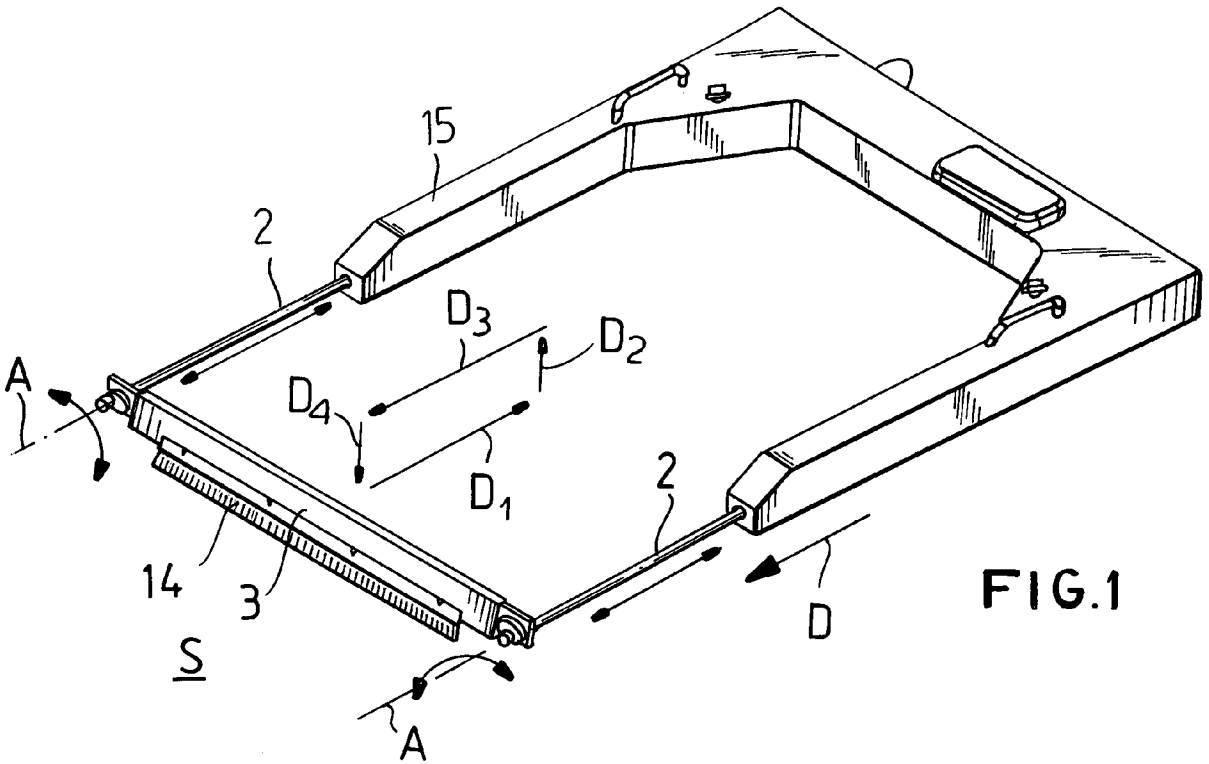
FIG. 1 is a perspective view from above of the apparatus of this invention.
Figure 8:
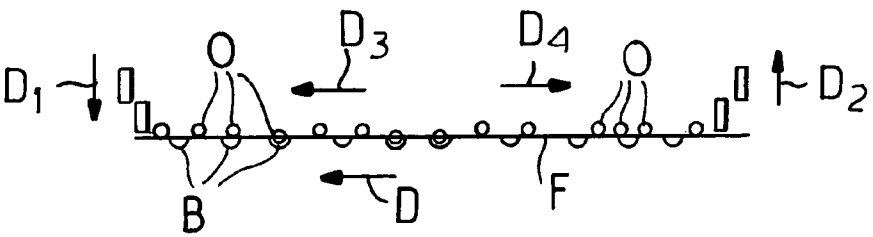
FIG. 8 is a largely schematic view illustrating operation of the apparatus according to the invention.

Outer ends of the rods 2 are seated in ends of a horizontal bar 3 that carries on its lower edge a brush 14 serving to sweep the objects O into the blisters B. More particularly as shown in FIGS. 1 and 8, the bar is first displaced upstream in direction $D_1$ while in a lowered position. When it reaches an upstream end position the rods 2 are rotated to raise the bar 3 and brush 14 as shown at $D_2$. Then the rods 2 are retracted to pull the bar 3 back downstream in direction $D_3$ while in this raised position, normally moving the bar faster than the film, and when fully downstream the rode 2 are again rotated to drop the bar 3 as shown by arrow $D_4$. The cycle can then repeat.

Figure 2:
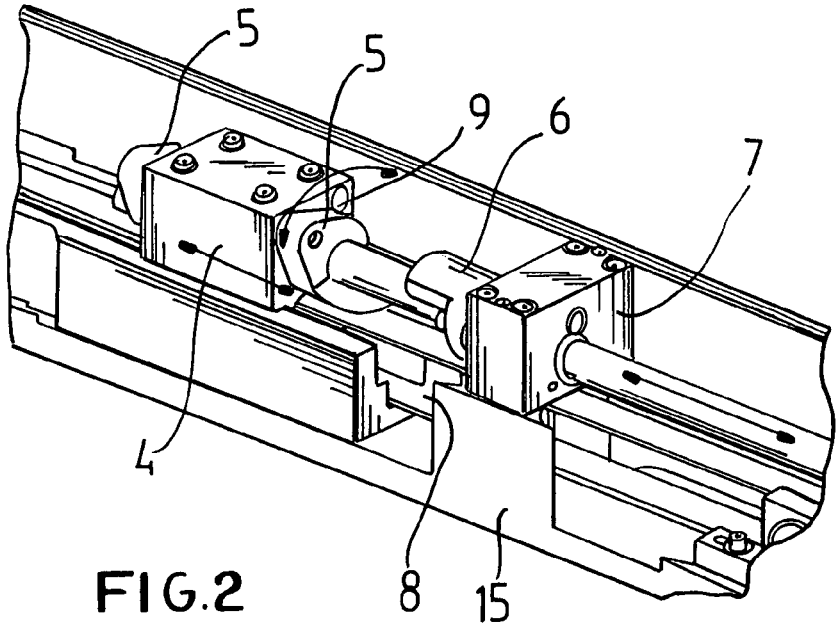
FIGS. 2 and 3 are larger-scale views from different angles of a detail of the apparatus.
Figure 3:
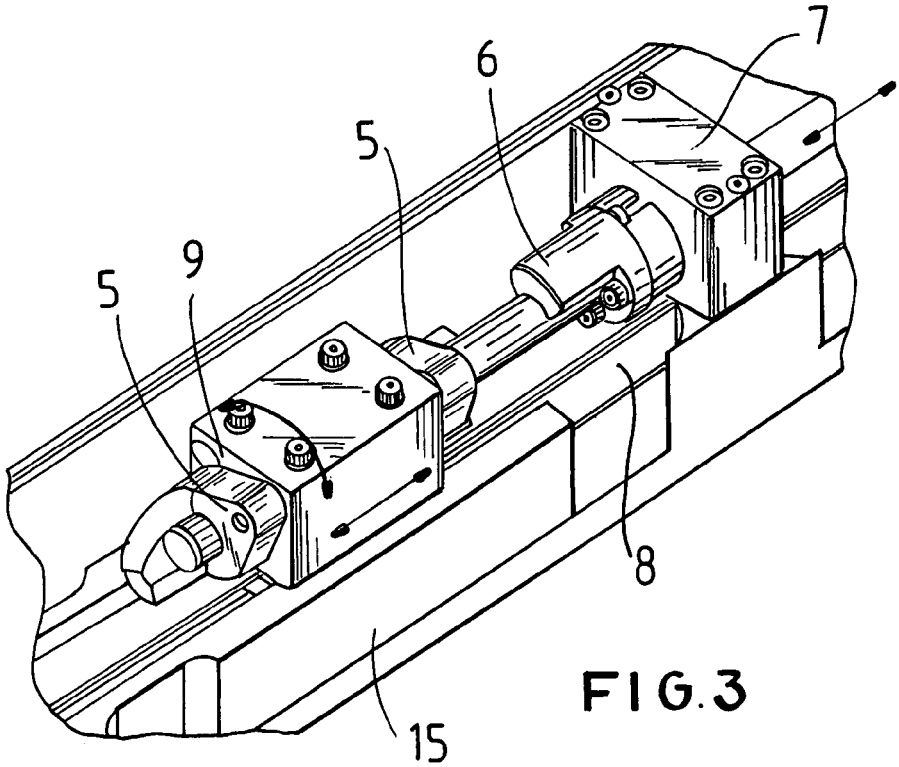

As shown in FIGS. 2 ad 3, the rods 2 are rotatably mounted in respective axially displaceable slides or carriages 4 carried on a stationary housing or frame 15 of the packaging machine. The rotation of each rod 2 on reaching the end position of the respective axial movement is brought about by the engagement of two spindle-shaped rod cam elements 5 in a cam-shaped pusher 6. The spindle-shaped elements 5 are rotationally fixed on the rods 2 and secured against axial displacement on the rod 2 in both directions to each side of the respective slide 4, so that they also serve for coupling the rods 2 the slides 4. The pusher 6, on the other hand, is nonrotatably mounted on a part 7 that is fixed on the housing 15 forming the linear guide. When the end position of the axial movement of the rod 2 is reached, the spindle-shaped element 6 is shifted angularly by the pusher 6 such that it rotates the associated rod 2. In the illustrated embodiment shown here.

The rotational positions of the rods 2 are releasably maintained by magnets 9 that are recessed flush with the surface in the carriage and secure the position of the associated spindle-shaped element 5. Thus once the rods 2 are shifted angularly into one or the other of their angular end positions, these magnets 9 maintain this position during axial stroking until the position is forcibly cammed into the other angular end position at the other axial end position.

Figure 4:
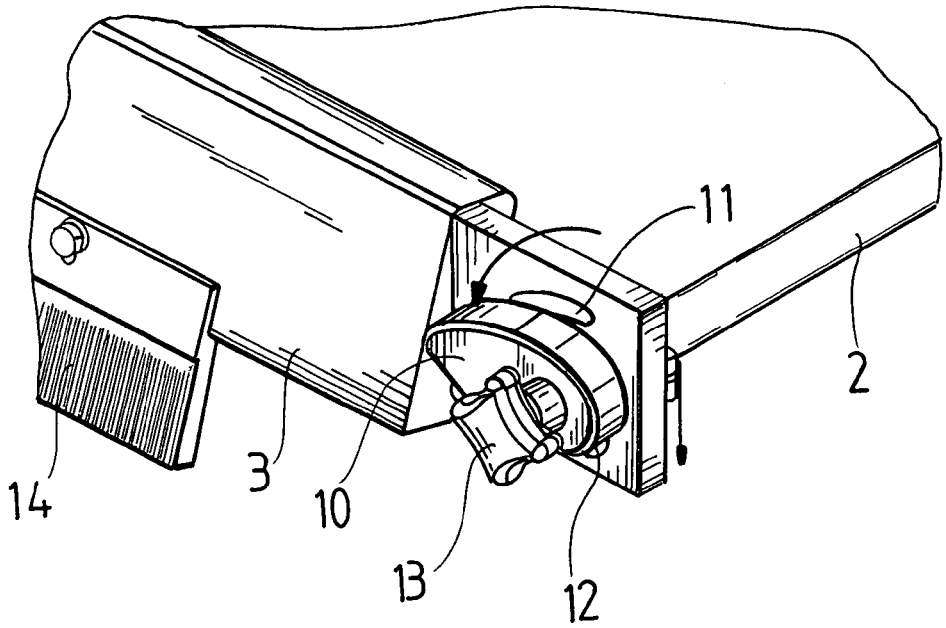
FIGS. 4 and 5 are larger-scale views of another detail of the apparatus in two different positions.
Figure 5:
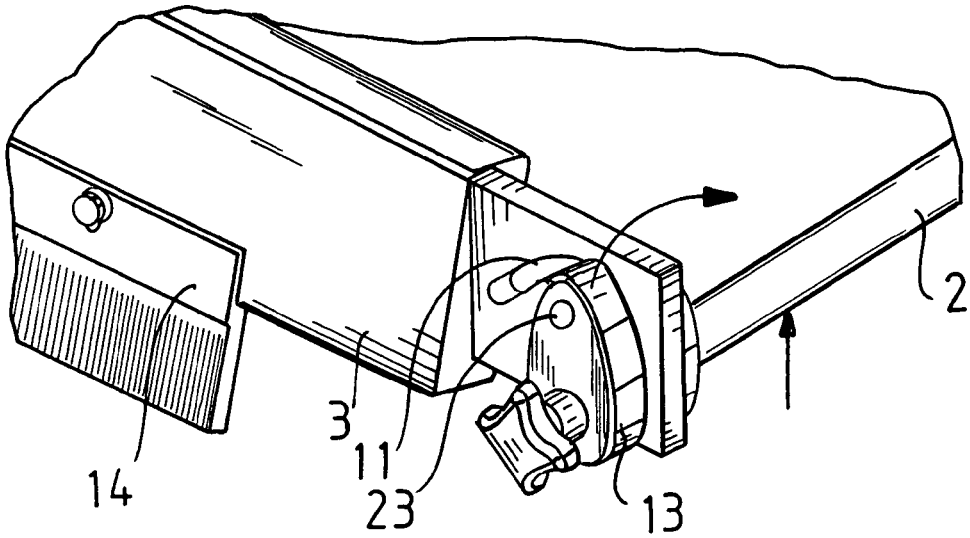

The translatory movement of the bar 3, as is shown in FIGS. 4 and 5 is effected by eccentrics 10 that are mounted on the outer free ends of the rods 2*a*. Thus the rotation of the rods is transmitted to the eccentrics 10 that carry pins 23 riding in respective cam slots 11 of the bar 3. The rods 2 pass through vertically elongated holes 12 in the bar ends to permit such relative transverse movement of the bar 3 and the rods 2. The eccentrics 10 are attached by means of respective detachable knurled knobs 13 on the free ends of the respective rods 2, thus allowing easy replacement of the components.

Figure 6:
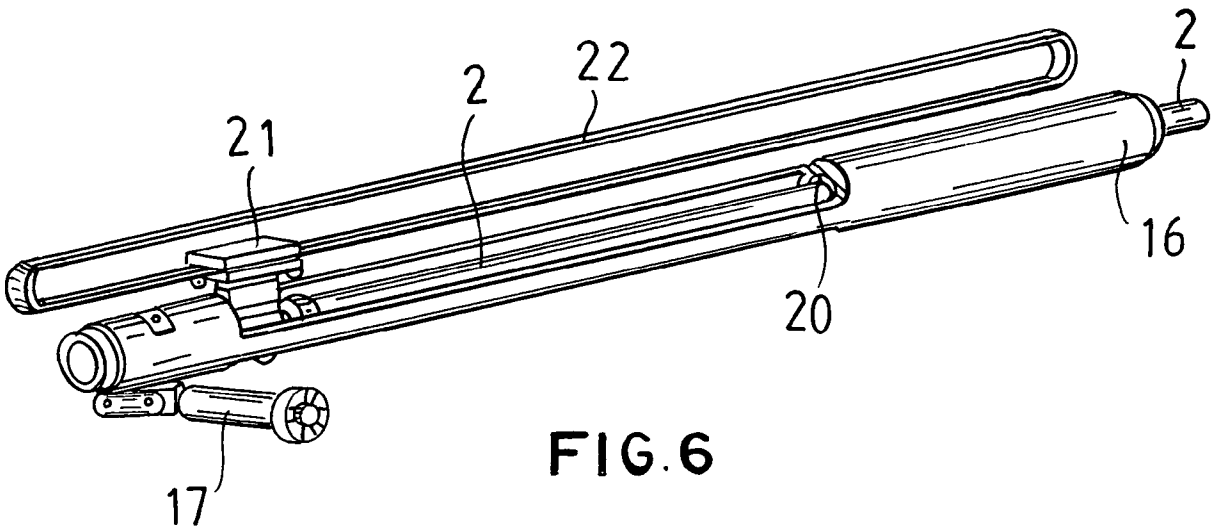
FIG. 6 is a perspective view showing a further detail of the apparatus.
Figure 7:
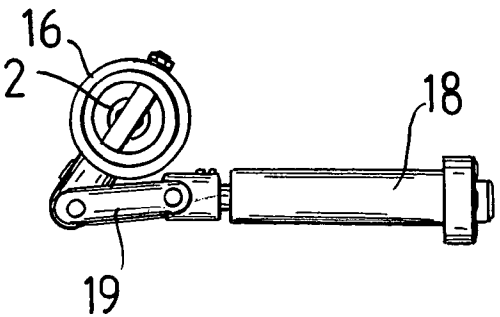
FIG. 7 is a side view of another detail of the apparatus.

According to a further embodiment shown in FIGS. 6 and 7 the angular movement of the rods 2 does not have to be forced only in the end positions of their axial movements, for which purpose the rods 2 are guided in a sleeve 16, respectively, which can be rotated by means of a drive mechanism 17 about the longitudinal axis. This drive mechanism 17 is formed by a pneumatic actuator 18 that acts on the sleeve 16 via a lever system 19.

The axial displacement of each rod 2 is possible in that a cutout 20 is formed in the sleeve 16, by means of which cutout a carriage 21 is connected to the rod a, which is associated with a toothed belt 22 serving for axial displacement.

We claim:

1. In a fill station of a packing machine where small object are loaded into blisters of a packaging film, an apparatus for distributing the objects to the blisters, the apparatus comprising:

a pair of generally parallel rods extending along respective axes and having inner and outer ends;

respective guides supporting the rods for movement parallel to their axes;

a bar extending transversely between the outer ends;

actuator means for periodically synchronously rotating the rods; and respective coupling means between each of the outer ends and the bar for transversely shifting the bar relative to the rods on rotation of the rods.

2. The apparatus defined in claim 1 wherein the axes are horizontal and the cooling means shift the bar vertically on rotation of the rods.

3. The apparatus defined in claim 1, further comprising respective axially displaceable slides in which the rods are axially fixed but rotatable.

4. The apparatus defined in claim 3, further comprising drive means for axially reciprocating the slides and rods between axial end positions, the coupling means shifting the bar transversely on movement of the rods into the end positions.

5. The apparatus defined in claim 4 wherein the coupling means shifts the bar vertically in one direction in one of the end positions and vertically in an opposite direction in the other of the end positions.

6. The apparatus defined in claims 4 wherein the actuator means includes interengageable cam elements fixed on the machine and cam elements fixed on the rods.

7. The apparatus defined in claim 6 wherein each rod carries two such cam elements axially fixed to the rod and axially closely flanking the respective slide to couple the rod to the slide.

8. The apparatus defined in claim 4 wherein the actuator means includes actuators connected to the slides.

9. The apparatus defined in claim 8 wherein the actuators include toothed belts.

10. The apparatus defined in claim 4 wherein the actuator means shift the rods between angularly offset end positions, the apparatus further comprising means for releasably retaining the rods in the angular end position.

11. The apparatus defined in claim 4 wherein the means includes magnets in the slides, the respective cam elements being magnetically attractable.

12. The apparatus defined in claim 4 wherein the actuator means includes respective sleeves surrounding the rods, to which the rods are rotationally coupled, and in which the rods are axially shiftable, and actuator connected between the machine and the sleeves for rotating the sleeves about the axes.

13. The apparatus defined in claim 12 wherein the actuators are pneumatic.

14. The apparatus defined in claim 12 wherein the sleeves are formed with axially elongated cutouts through which the rods are connected to the drive mean through the cutouts.

15. The apparatus defined in claim 4 wherein the coupling means includes an eccentric fixed the outer end of each rod and coupled to the bar.

16. The apparatus defined in claim 15 wherein the bar is formed with a pair of vertically elongated slots through which the rods extend and offset therefrom with an angled cam slot coupled to the respective eccentric.

17. The apparatus defined in claim 16 wherein each cam carries an eccentric pin engaging in the respective cam slot.

18. The apparatus defined in claim 16, further comprising means releasably securing the eccentric on the outer ends of the rods.

19. The apparatus defined in claim 18 wherein the means releaseably securing is a knurled knob.

20. The apparatus defined in claim 1 wherein the bar carries a brush slidable along the film.

* * * * *